US005371994A

United States Patent [19]

Waters

[11] Patent Number: 5,371,994

[45] Date of Patent: Dec. 13, 1994

[54] CEILING SHEET INSTALLATION APPARATUS

[76] Inventor: Paul S. Waters, 67-11 Springfield Blvd., Bayside, N.Y. 11364

[21] Appl. No.: 100,262

[22] Filed: Aug. 2, 1993

[51] Int. Cl.[5] ..... E04F 21/18

[52] U.S. Cl. ..... 52/749; 52/DIG. 1; 248/488; 411/400; 411/409

[58] Field of Search ..... 52/127.2, 749, DIG. 1; 248/291, 475.1, 488; 403/105, 97; 411/400, 401, 409

[56] References Cited

U.S. PATENT DOCUMENTS

| | | | |
|---|---|---|---|
| 3,387,814 | 6/1968 | Fischer | 411/401 X |
| 4,449,338 | 5/1984 | Reicherts | 52/749 X |
| 4,747,737 | 5/1988 | Roffelsen | 411/400 X |
| 4,811,926 | 3/1989 | Marsh et al. | 248/488 |
| 5,002,446 | 3/1991 | Anderson | 52/DIG. 1 X |
| 5,059,077 | 10/1991 | Schmid | 411/400 |

*Primary Examiner*—Carl D. Friedman
*Assistant Examiner*—Kevin D. Wilkens

[57] ABSTRACT

A new and improved ceiling sheet installation apparatus includes a set of four ceiling-mounted sheet material support assemblies. Each sheet material support assembly includes a ceiling mounting portion and a sheet retaining portion. The ceiling mounting portion includes a channel for receiving a fastener for attaching to a fixed object in a ceiling. The sheet retaining portion includes a sloped upper surface for receiving an edge of the sheet material and for retaining the sheet material adjacent to the ceiling by supporting the edge of the sheet material. With the sloped upper surface, the edge of the sheet material is wedged between the sloped upper surface and the ceiling. The channel is oriented in the ceiling mounting portion such that the sheet material support assembly is capable of selectively rotating around the fastener to and from two positions. A closed position is such that an edge of the sheet material is supported by the sloped upper surface of the sheet retaining portion, and an open position is such that an edge of the sheet material is not supported by the sloped upper surface of the sheet retaining portion. Once the sheet of material is completely supported by the sheet material support assemblies of the invention. A worker has his hands free to permanently fasten the sheet of material to the ceiling, a hinge assembly may be supported by the ceiling mounting portion connecting the ceiling mounting portion and the sheet retaining portion, and the sheet retaining portion can be moved from an open position to a closed position around the hinge assembly.

4 Claims, 4 Drawing Sheets

CEILING SHEET INSTALLATION APPARATUS

BACKGROUND OF THE INVENTION

1. Field of the Invention

The present invention relates generally to methods and apparatus for installing sheet materials in buildings, and, more particularly, to methods and apparatus especially adapted for installing sheet materials on ceilings.

2. Description of the Prior Art

Installation of sheet materials in buildings is a common practice in the building trades. Of special difficulty is the installation of sheet materials on ceilings. Generally, installing materials, such as sheet rock, on ceilings requires two persons, one to hold the sheet material against the ceiling, and the other person to nail or screw the sheet material into secure attachment with the ceiling. In this respect, it would be desirable if a device were provided for installing sheet materials on a ceiling which does not require the labor of two persons, one to hold the sheet material in position and the other to secure the sheet material onto the ceiling.

When a person is required to hold a sheet material against the ceiling, the person often undergoes unpleasant stress and strain. Holding a heavy piece of sheet material above one's head is very fatiguing. Gravity is opposing both the raising of the lifter's hands and arms and the retaining of the sheet material against the ceiling. In this respect, it would be desirable if a device were provided for installing sheet materials on a ceiling which does not require a person to hold the weight of sheet material over his head prior to securing the sheet material to the ceiling.

Throughout the years, a number of innovations have been developed relating to installation of sheet materials on ceilings. The following U.S. patents are representative of some of those innovations: U.S. Pat. Nos. 3,871,477; 4,709,527; 4,733,844; and 4,928,916. More specifically, U.S. Pat. No. 3,871,477 discloses a large, complex, heavy, hydraulically operated and expensive sheetrock lift and scaffold. Such a large and heavy device is impractical also because it takes up great quantities of space in storage and transportation. In view of these undesirable features with this patent, it would be desirable if a device for aiding in the installation of sheetrock on a ceiling would be small, simple in operation and construction, lightweight, manually operated, and take up little space in storage and transportation.

U.S. Pat. No. 4,709,527 discloses a small, simple, lightweight, manually operated sheetrock hanging tool. A problem associated with this device is that, for a large piece of sheetrock, it appears that two persons must be involved in the installation. More specifically, the device in this patent is installed at the edge of a piece of sheetrock. A piece of sheetrock has its center of gravity located near the center of the piece of sheetrock. With a large piece of sheetrock, the center of the sheetrock is quite far from the edge of the piece. As such, quite a bit of leverage is created by gravity for the center of gravity around the edge of the sheetrock. This leverage of the center of gravity around the edge of the sheetrock makes it difficult for one person to install a large piece of sheetrock using the device shown in this patent. In this respect, it would be desirable if a device were provided for installing large pieces of sheet materials on a ceiling so that the fact that the center of gravity of the large piece is located quite a distance from the edge of the large piece would not prevent one person from installing the large piece on a ceiling.

Both U.S. Pat. Nos. 4,733,844 and 4,928,916 show similar devices for supporting sheetrock on a ceiling. The devices are in the form of adjustable height columns that are erected from floor to ceiling. These devices have the advantage of being usable by one person for a ceiling-mounted sheetrock installation. However, a number of disadvantages are also associated with these devices. To use these devices for supporting the sheetrock on the ceiling, the sheetrock must first be lifted to the ceiling in a horizontal orientation. It appears that these devices do not aid in the actual lifting of the sheetrock to the ceiling. In this respect, it would be desirable if a device were provided for installing sheet materials on a ceiling which facilitates lifting the sheet materials from floor level to the ceiling.

The devices disclosed in U.S. Pat. Nos. 4,733,844 and 4,928.916 have quite a large number of components connected to each other. There is a horizontal planar element that fits under the sheetrock. There are at least three mutually adjustable vertically oriented elements that enable a vertical height adjustment from floor to ceiling. The complexity of these devices stems from the fact that the sheetrock on the ceiling is supported by a floor-based support. In this respect it would be desirable if a device were provided for installing sheet materials on a ceiling which does not depend upon a floor-based support.

A floor-based support has another disadvantage. By the sheetrock support occupying space on the floor, a workers mobility on the floor is reduced for fear of bumping into the floor-based support and causing the sheetrock to fall from the ceiling. In this respect, it would be desirable if a device were provided for installing sheet materials on a ceiling which did not occupy floor space and did not impede a worker's movement on a floor for fear of knocking out a floor-based support for the sheetrock held against the ceiling.

In addition, U.S. Pat. No. 4,257,205 may be of interest for its disclosure of an attachment system for suspending drywall ceiling panels. This device is for permanent installation of the ceiling panels. In contrast, when a worker installs sheet materials on a ceiling, the worker wants to use installation aids that are used only temporarily. That is, the worker wants to use them for installation, but the worker does not want to leave them on the ceiling permanently. This certainly is not practical for installation aids that protrude from the ceiling and are clearly visible from the floor below when the installation devices are employed. In this respect, it would be desirable if a device were provided for installing sheet materials on a ceiling which were used on a temporary basis, just during installation, and are removed when installation is completed to be used over and over again.

Still other features would be desirable in an apparatus for installing sheet material on a ceiling. The apparatus itself should be easily installed and easily removed so that it can be easily reused. To suspend a relatively heavy piece of sheet material from a ceiling, the ceiling sheet installation apparatus should be capable of being secured strongly to a ceiling structure so it can adequately bear the weight of the sheet material.

Thus, while the foregoing body of prior art indicates it to be well known to use supports for supporting sheetrock against a ceiling, the prior art described above does not teach or suggest a ceiling sheet installation apparatus which has the following combination of desirable features: (1) does not require the labor of two persons, one to hold the sheet material in position and the other to secure the sheet material onto the ceiling; (2) does not require a person to hold the weight of sheet material over his head prior to securing the sheet material to the ceiling; (3) can be easily installed and easily removed so that it can be easily reused; (4) is small, simple in operation and construction, lightweight, manually operated, and takes up little space in storage and transportation; (5) provides for installing large pieces of sheet materials on a ceiling so that the fact that the center of gravity of the large piece is located quite a distance from the edge of the large piece does not prevent one person from installing the large piece on a ceiling by himself; (6) facilitates lifting the sheet materials from floor level to the ceiling; (7) does not depend upon a floor-based support; (8) does not impede a worker's movement on a floor for fear of hocking out a floor-based support for sheetrock held against the ceiling; (9) provides for installing sheet materials on a ceiling which are used on a temporary basis, just during installation, and are removed when installation is completed to be used over and over again; and (10) is capable of being secured strongly to a ceiling structure so it can adequately bear the weight of the sheet material. The foregoing desired characteristics are provided by the unique ceiling sheet installation apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved ceiling sheet installation apparatus which includes a set of at least three ceiling-mounted sheet material support assemblies, preferably four support assemblies. Each sheet material support assembly includes a ceiling mounting portion and a sheet retaining portion. The ceiling mounting portion includes a channel for receiving a fastener for attaching to a fixed object in a ceiling. The sheet retaining portion includes a sloped upper surface for receiving an edge of the sheet material and for retaining the sheet material adjacent to the ceiling by supporting the edge of the sheet material. With the sloped upper surface, the edge of the sheet material is wedged between the sloped upper surface and the ceiling.

The channel is oriented in the ceiling mounting portion such that the sheet material support assembly is capable of selectively rotating around the fastener to and from two positions. A closed position is such that an edge of the sheet material is supported by the sloped upper surface of the sheet retaining portion, and an open position is such that an edge of the sheet material is not supported by the sloped upper surface of the sheet retaining portion.

Once the sheet of material is completely supported by the sheet material support assemblies of the invention, a worker has his hands free to permanently fasten the sheet of material to the ceiling. It is clear from the above description that one person can install the sheet material on the ceiling without is aided by a second worker. After one sheet of material is installed, the sheet material support assemblies can be removed from their current positions and repositioned on other locations of the ceiling for installing additional sheets of material on the ceiling.

A hinge assembly may be supported by the ceiling mounting portion connecting the ceiling mounting portion and the sheet retaining portion, such that, when the sheet retaining portion is in an open position, a sheet material can be moved past the sheet retaining portion into a position adjacent to the ceiling, and when the sheet material is adjacent the ceiling, the sheet retaining portion can be moved around the hinge into the closed position whereby the sloped upper surface of the sheet retaining portion retains the sheet material in a position adjacent to the ceiling.

The hinge assembly includes a hinge oriented such that the sheet retaining portion rotates with respect to the ceiling mounting portion around an axis that is in a plane parallel to the ceiling, whereby, when the ceiling mounting portion is mounted on the ceiling, the sheet retaining portion can be swung into position to support an edge of the sheet material.

The hinge assembly further includes a ratchet assembly which is connected to the ceiling mounting portion, and a pawl assembly is connected to the sheet retaining portion, such that when the sheet retaining portion is moved from an open position to a closed position, the pawl assembly engages the ratchet assembly, and the sheet retaining portion becomes locked into the closed position by the engagement between the ratchet assembly and the pawl assembly.

The ratchet assembly includes a slidable ratchet teeth support supported by the ceiling mounting portion. A plurality of ratchet teeth are supported by the slidable ratchet teeth support, and a spring is located between the ceiling mounting portion and the slidable ratchet teeth support for urging the ratchet teeth in engagement with the pawl assembly.

In accordance with another aspect of the invention, a method is provided for installing a sheet material on a ceiling. The installation method includes the steps of:

(i) installing first and second sheet material support assemblies onto a ceiling structure at respective first and second ceiling locations;

(ii) orienting the first and second sheet material support assemblies in a closed position;

(iii) installing third and fourth sheet material support assemblies onto a ceiling structure at respective third and fourth ceiling locations, such that the respective third and fourth ceiling locations are spaced from the respective first and second ceiling locations by a predetermined distance permitting placement of a sheet of material between the four sheet material support assemblies;

(iv) orienting the third and fourth sheet material support assemblies in an open position;

(v) lifting a sheet of material so that a leading edge of the sheet material is elevated above a trailing edge;

(vi) placing portions of the leading edge of the sheet material upon sloped upper surfaces of the closed sheet material support assemblies and permitting the leading edge of the sheet material to rest upon and be supported by the sloped upper surfaces;

(vii) lifting the trailing edge of the sheet of material whereby the trailing edge pivots around the leading edge that is supported by the first and second sheet material support assemblies;

(viii) placing the trailing edge of the sheet of material adjacent to the ceiling; and (ix) orienting the third and fourth sheet material support assemblies into the closed position, whereby the trailing edge of the sheet of material is supported adjacent to the ceiling by sloped upper surfaces of the third and fourth sheet material support assemblies, whereby the sheet is supported by the four sheet material support assemblies adjacent to the ceiling.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved ceiling sheet installation apparatus which has all of the advantages of the prior art and none of the disadvantages.

It is another object of the present invention to provide a new and improved ceiling sheet installation apparatus which may be easily and efficiently manufactured and marketed.

It is a further object of the present invention to provide a new and improved ceiling sheet installation apparatus which is of durable and reliable construction.

An even further object of the present invention is to provide a new and improved ceiling sheet installation apparatus which is susceptible of a low cost of manufacture with regard to both materials and labor, and which accordingly is then susceptible of low prices of sale to the consuming public, thereby making such ceiling sheet installation apparatus available to the buying public.

Still yet a further object of the present invention is to provide a new and improved ceiling sheet installation apparatus which does not require the labor of two persons, one to hold the sheet material in position and the other to secure the sheet material onto the ceiling.

Still another object of the present invention is to provide a new and improved ceiling sheet installation apparatus that does not require a person to hold the weight of sheet material over his head prior to securing the sheet material to the ceiling.

Yet another object of the present invention is to provide a new and improved ceiling sheet installation apparatus which can be easily installed and easily removed so that it can be easily reused.

Even another object of the present invention is to provide a new and improved ceiling sheet installation apparatus that is small, simple in operation and construction, lightweight, manually operated, and takes up little space in storage and transportation.

Still a further object of the present invention is to provide a new and improved ceiling sheet installation apparatus which provides for installing large pieces of sheet materials on a ceiling so that the fact that the center of gravity of the large piece is located quite a distance from the edge of the large piece does not prevent one person from installing the large piece on a ceiling by himself.

Yet another object of the present invention is to provide a new and improved ceiling sheet installation apparatus that facilitates lifting the sheet materials from floor level to the ceiling.

Still another object of the present invention is to provide a new and improved ceiling sheet installation apparatus which does not depend upon a floor-based support.

Yet another object of the present invention is to provide a new and improved ceiling sheet installation apparatus that does not impede a worker's movement on a floor for fear of knocking out a floor-based support for sheetrock held against the ceiling.

Still a further object of the present invention is to provide a new and improved ceiling sheet installation apparatus that provides for installing sheet materials on a ceiling which are used on a temporary basis, just during installation, and are removed when installation is completed to be used over and over again.

Yet another object of the present invention is to provide a new and improved ceiling sheet installation apparatus which is capable of being secured strongly to a ceiling structure so it can adequately bear the weight of the sheet material.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

With reference to the drawings, a new and improved ceiling sheet installation apparatus embodying the principles and concepts of the present invention will be described.

Figure 5:
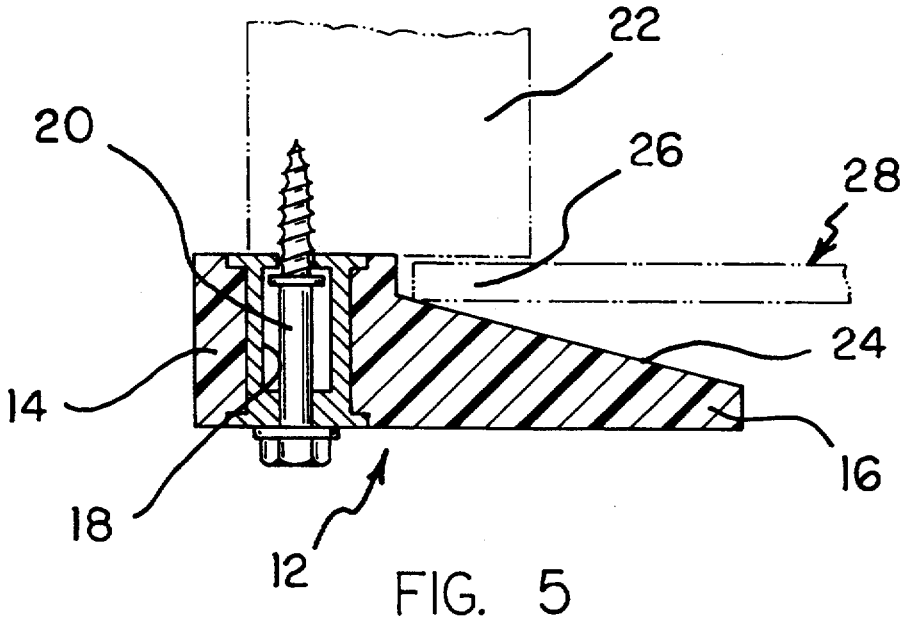
FIG. 5 is an enlarged side cross-sectional view of one of the support assemblies of the invention shown in FIG. 3 with the sheetrock installed in contact with the ceiling.

Turning initially to FIGS. 1–5, there is shown a first exemplary embodiment of the ceiling sheet installation apparatus of the invention including a set of at least three ceiling-mounted sheet material support assemblies. Preferably, four sheet material support assemblies 12 are employed. As shown in FIG. 5, each sheet material support assembly 12 includes a ceiling mounting portion 14 and a sheet retaining portion 16. The ceiling mounting portion 14 includes a channel 18 for receiving a fastener 20, shown as a lag bolt 20, for attaching to a fixed object 22, such as a joist 22, in a ceiling. The sheet retaining portion 16 includes a sloped upper surface 24 for receiving an edge 26 of the sheet material 28 and for retaining the sheet material 28 adjacent to the ceiling by supporting the edge 26 of the sheet material 28. With the sloped upper surface, the edge of the sheet material is wedged between the sloped upper surface and the ceiling.

The channel 18 is oriented in the ceiling mounting portion 14 such that the sheet material support assembly 12 is capable of selectively rotating around the fastener 20 to and from two positions. A closed position 25 is such that an edge 26 of the sheet material 28 is supported by the sloped upper surface 24 of the sheet retaining portion 16, and an open position 27 is such that an edge 26 of the sheet material 28 is not supported by the sloped upper surface 24 of the sheet retaining portion 16.

Figure 1:
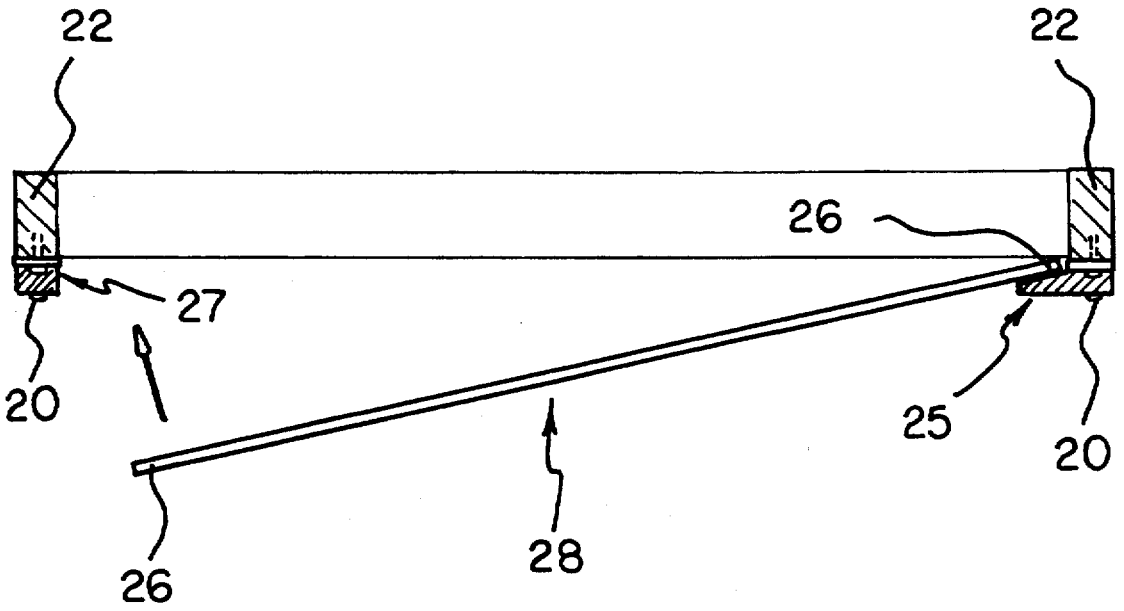
FIG. 1 is a side view of a first preferred embodiment of the ceiling sheet installation apparatus of the invention wherein an edge of a panel of sheetrock has been placed upon two ceiling-mounted support assemblies.
Figure 2:
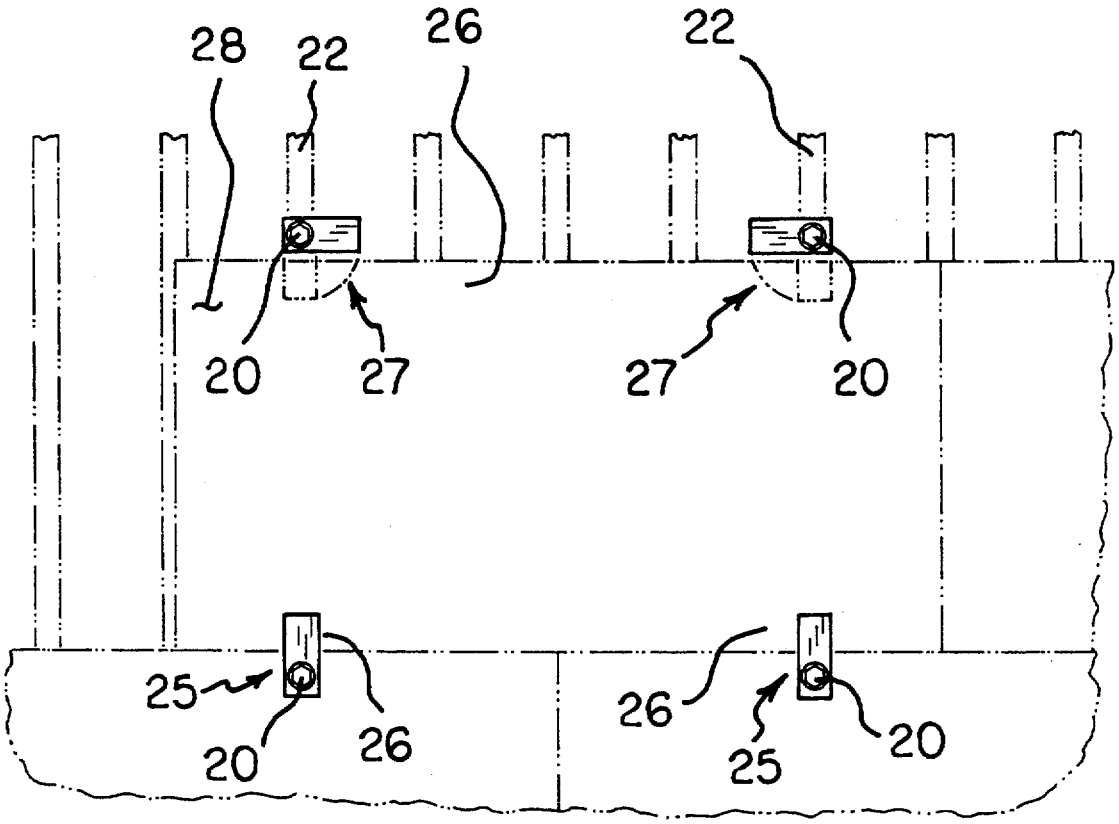
FIG. 2 is a bottom view of the embodiment of the invention shown in FIG. 1.
Figure 4:
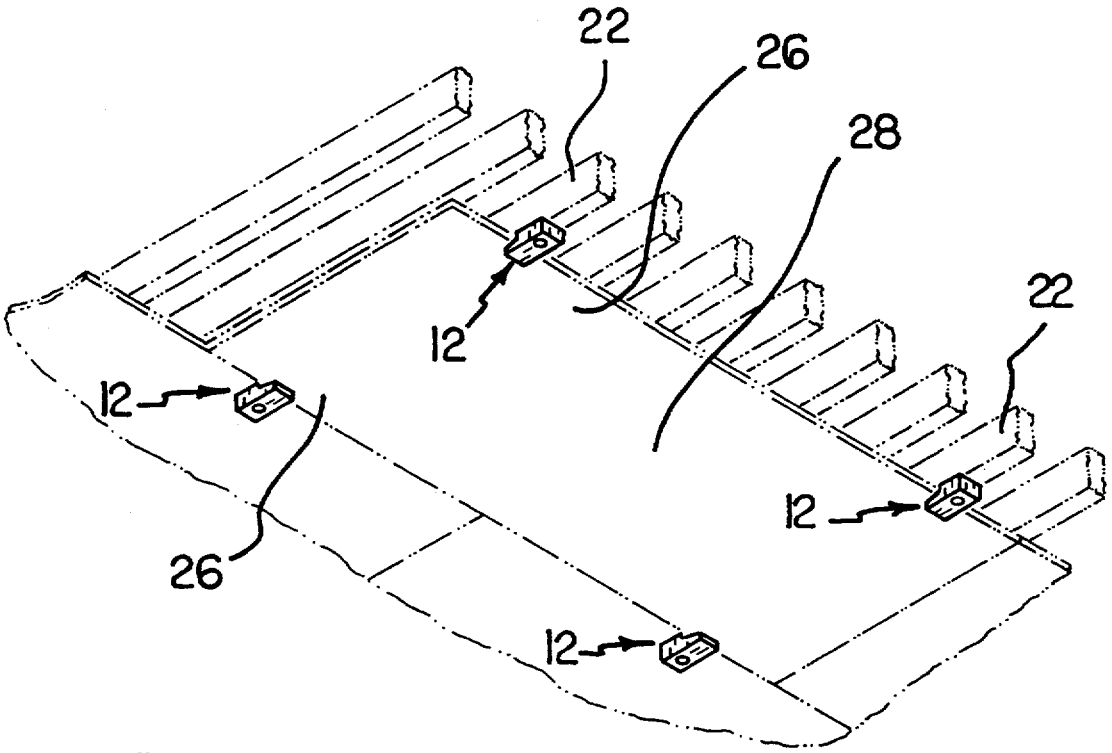
FIG. 4 is a bottom perspective view of the embodiment of the invention shown in FIG. 3 with the sheetrock in contact with the ceiling.
Figure 3:
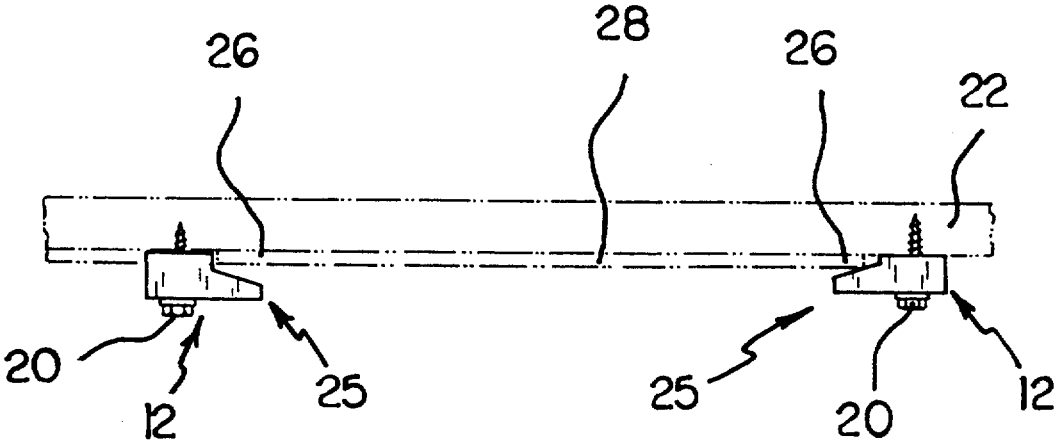
FIG. 3 is a side view of the ceiling sheet installation apparatus of FIG. 1 shown after the sheetrock has been installed and locked into place in contact with the ceiling.

In operation, a method for installing a sheet material 28 on a ceiling, in accordance with the invention, is comprised of the following steps:

(i) installing first and second sheet material support assemblies 12 onto a ceiling structure at respective first and second ceiling locations;

(ii) orienting the first and second sheet material support assemblies 12 in a closed position;

(iii) installing third and fourth sheet material support assemblies 12 onto a ceiling structure at respective third and fourth ceiling locations, such that the respective third and fourth ceiling locations are spaced from the respective first and second ceiling locations by a predetermined distance permitting placement of a sheet 28 of material between the four sheet material support assemblies 12;

(iv) orienting the third and fourth sheet material support assemblies 12 in an open position;

(v) lifting a sheet 28 of material so that a leading edge of the sheet material is elevated above a trailing edge;

(vi) placing portions of the leading edge of the sheet material upon sloped upper surfaces 24 of the closed sheet material support assemblies 12 and permitting the leading edge of the sheet material 28 to rest upon and be supported by the sloped upper surfaces 24; (up to this point in the installation method is shown in FIGS. 1 and 2);

(vii) lifting the trailing edge of the sheet 28 of material whereby the trailing edge pivots around the leading edge that is supported by the first and second sheet material support assemblies 12;

(viii) placing the trailing edge of the sheet 28 of material adjacent to the ceiling; and orienting the third and fourth sheet material support assemblies 12 into the closed position, whereby the trailing edge of the sheet 28 of material is supported adjacent to the ceiling by sloped upper surfaces 24 of the third and fourth sheet material support assemblies 12, whereby the sheet 28 is supported by the four sheet material support assemblies 12 adjacent to the ceiling (up to this point in the installation method is shown in FIGS. 3 and 4).

Once the sheet of material is completely supported by the sheet material support assemblies 12 of the invention, a worker has his hands free to permanently fasten the sheet of material to the ceiling. It is clear from the above description that one person can install the sheet material on the ceiling without is aided by a second worker. After one sheet of material is installed, the sheet material support assemblies 12 can be removed from their current positions and repositioned on other locations of the ceiling for installing additional sheets of material on the ceiling.

Figure 6:
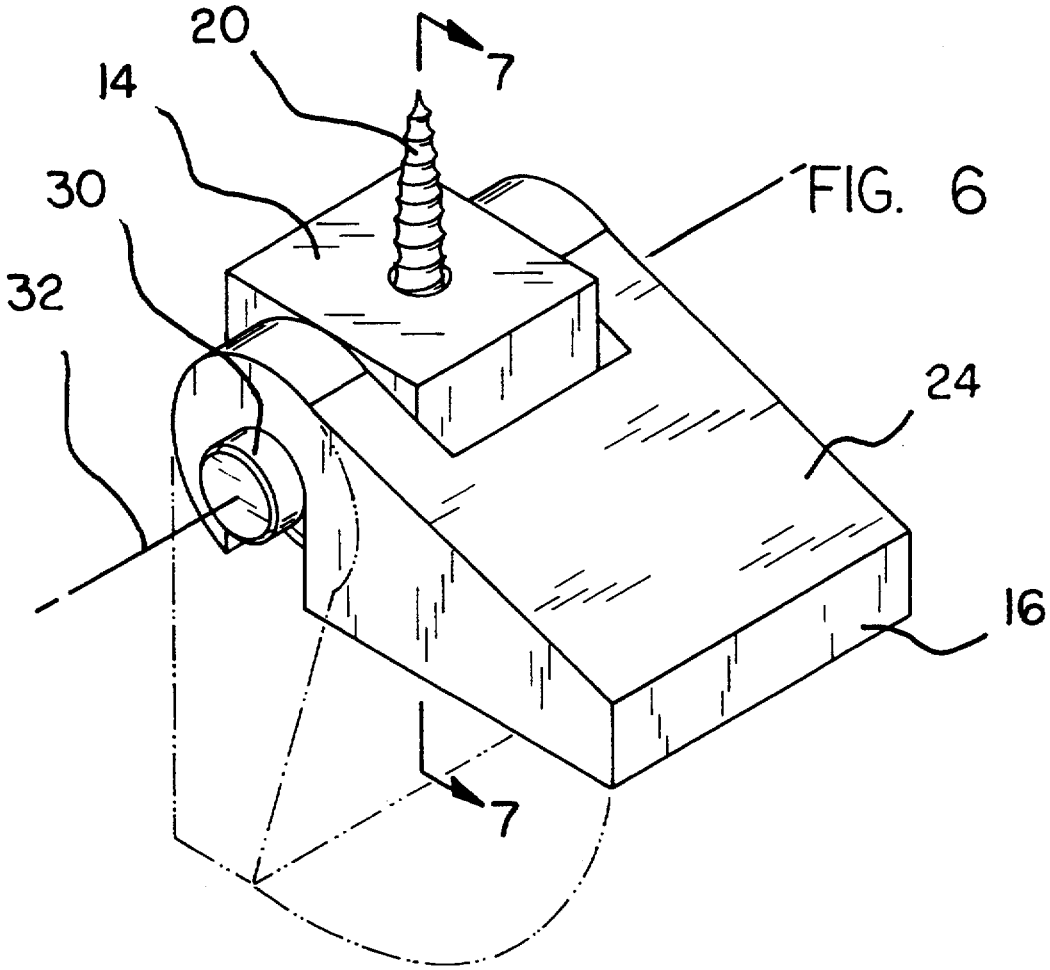
FIG. 6 is an enlarged perspective view of a second embodiment of the ceiling-mounted support assembly of the invention.
Figure 7:
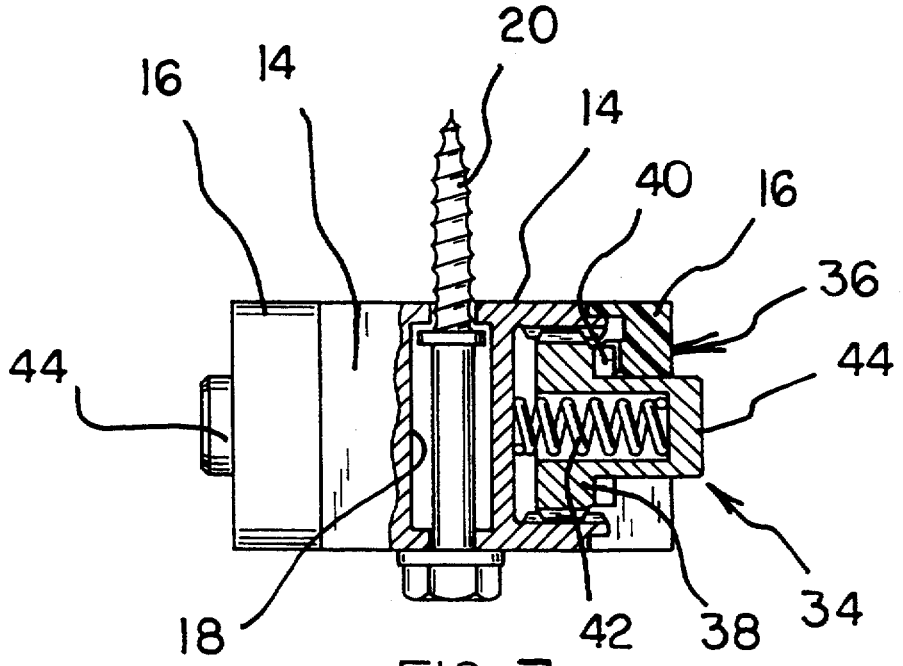
FIG. 7 is a cross-sectional view of the embodiment of the invention shown in FIG. 6 taken along line 7—7 thereof.

Turning to FIGS. 6–7, a second embodiment of the invention is shown. Reference numerals are shown that correspond to like reference numerals that designate like elements shown in the other figures. In addition, a hinge assembly is supported by the ceiling mounting portion 14 connecting the ceiling mounting portion 14 and the sheet retaining portion 16, such that, when the sheet retaining portion 16 is in an open position 27, a sheet material 28 can be moved past the sheet retaining portion 16 into a position adjacent to the ceiling, and when the sheet material 28 is adjacent the ceiling, the sheet retaining portion 16 can be moved around the hinge 30 into the closed position whereby the sloped upper surface 24 of the sheet retaining portion 16 retains the sheet material 28 in a position adjacent to the ceiling.

Two hinge assemblies are attached to each ceiling mounting portion 14. The hinge assembly includes a hinge 30 oriented such that the sheet retaining portion 16 rotates with respect to the ceiling mounting portion 14 around an axis 32 that is in a plane parallel to the ceiling, whereby, when the ceiling mounting portion 14 is mounted on the ceiling, the sheet retaining portion 16 can be swung into position to support an edge 26 of the sheet material 28.

The hinge assembly further includes a ratchet assembly 34 which is connected to the ceiling mounting portion 14, and a pawl assembly 36 is connected to the sheet retaining portion 16, such that when the sheet retaining portion 16 is moved from an open position to a closed position, the pawl assembly 36 engages the ratchet assembly 34, and the sheet retaining portion 16 becomes locked into the closed position by the engagement between the ratchet assembly 34 and the pawl assembly 36.

The ratchet assembly 34 includes a slidable ratchet teeth support 38 supported by the ceiling mounting portion 14. A plurality of ratchet teeth 40 are supported by the slidable ratchet teeth support 38, and a spring 42 is located between the ceiling mounting portion 14 and the slidable ratchet teeth support 38 for urging the ratchet teeth 40 in engagement with the pawl assembly 36.

To release the pawl assembly 36 from the ratchet teeth 40 to return the sheet retaining portion 16 to the open position, a button end 44 is pressed. This pressing action permits the slidable ratchet teeth support 38 to be slid further inside the ceiling mounting portion 14 against the urging of the spring 42. Upon moving toward the ceiling mounting portion 14, the ratchet teeth 40 are released from the pawl assembly 36, and the sheet retaining portion 16.

The components of the ceiling sheet installation apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved ceiling sheet installation apparatus that is low in cost, relatively simple in design and operation, and which may advantageously be used to provide a ceiling sheet installation apparatus which does not require the labor of two persons, one to hold the sheet material in position and the other to secure the sheet material onto the ceiling. With the invention, a ceiling sheet installation apparatus is provided which does not require a person to hold the weight of sheet material over his head prior to securing the sheet material to the ceiling. With the invention, a ceiling sheet installation apparatus is provided which can be easily installed and easily removed so that it can be easily reused. With the invention, a ceiling sheet installation apparatus is provided which is small, simple in operation and construction, lightweight, manually operated, and takes up little space in storage and transportation. With the invention, a ceiling sheet installation apparatus is provided which provides for installing large pieces of sheet materials on a ceiling so that the fact that the center of gravity of the large piece is located quite a distance from the edge of the large piece does not prevent one person from installing the large piece on a ceiling by himself. With the invention, a ceiling sheet installation apparatus is provided which facilitates lifting the sheet materials from floor level to the ceiling. With the invention, a ceiling sheet installation apparatus is provided which does not depend upon a floor-based support. With the invention, a ceiling sheet installation apparatus is provided which does not impede a worker's movement on a floor for fear of knocking out a floor-based support for sheetrock held against the ceiling. With the invention, a ceiling sheet installation apparatus is provided which provides for installing sheet materials on a ceiling which are used on a temporary basis, just during installation, and are removed when installation is completed to be used over and over again. With the invention, a ceiling sheet installation apparatus is provided which is capable of being secured strongly to a ceiling structure so it can adequately bear the weight of the sheet material.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved ceiling sheet installation apparatus, comprising:

a ceiling-mounted sheet material support assembly, said sheet material support assembly including a ceiling mounting portion and a sheet retaining portion, said ceiling mounting portion including a channel for receiving a fastener for attaching to a fixed object in a ceiling, said sheet retaining portion including a sloped upper surface for receiving an edge of the sheet material and for retaining the sheet material adjacent to the ceiling by supporting the edge of the sheet material, wherein said channel is oriented in said ceiling mounting portion such that said sheet material support assembly is capable of selectively rotating around said fastener to and from two positions, a closed position being such that an edge of the sheet material is supported by said sloped upper surface of said sheet retaining portion, and an open position being such that an edge of the sheet material is not supported by said sloped upper surface of said sheet retaining portion, further including:

a hinge assembly supported by said ceiling mounting portion connecting said ceiling mounting portion and said sheet retaining portion, such that, when said retaining portion is in an open position, a sheet material can be moved past said sheet retaining portion into a position adjacent to the ceiling, and when the sheet material is adjacent the ceiling, said sheet retaining portion can be moved around said hinge into the closed position whereby said sloped upper surface of said sheet retaining portion retains the sheet material in a position adjacent to the ceiling.

2. The apparatus described in claim 1 wherein said hinge assembly includes:

a hinge oriented such that said sheet retaining portion rotates with respect to said ceiling mounting portion around an axis that is in a plane parallel to the ceiling, whereby, when said ceiling mounting portion is mounted on the ceiling, said sheet retaining portion can be swung into position to support an edge of the sheet material.

3. The apparatus described in claim 2 wherein said hinge assembly further includes:

a ratchet assembly connected to said ceiling mounting portion, and a pawl assembly connected to said sheet retaining portion, such that when said sheet retaining portion is moved from an open position to a closed position, said pawl assembly engages said ratchet assembly and said sheet retaining portion becomes locked into the closed position by the engagement between said ratchet assembly and said pawl assembly.

4. The apparatus described in claim 3 wherein said ratchet assembly includes:

a slidable ratchet teeth support supported by said ceiling mounting portion, a plurality of ratchet teeth supported by said slidable ratchet teeth support, and a spring located between said ceiling mounting portion and said slidable ratchet teeth support for urging said ratchet teeth in engagement with said pawl assembly.

* * * * *